United States Patent [19]

Ramage

[11] Patent Number: 4,492,010

[45] Date of Patent: Jan. 8, 1985

[54] GAS CHECK SEATING BODY

[75] Inventor: C. Kenneth Ramage, Middletown, Conn.

[73] Assignee: Lyman Products Corporation, Middlefield, Conn.

[21] Appl. No.: 513,758

[22] Filed: Jul. 14, 1983

[51] Int. Cl.[3] ..... B21K 21/06

[52] U.S. Cl. ..... 29/1.22; 29/1.2; 29/1.23; 102/514

[58] Field of Search ..... 29/1.22, 1.23, 1.2; 102/514; 411/147, 152, 384

[56] References Cited

U.S. PATENT DOCUMENTS

| | | | |
|---|---|---|---|
| 471,129 | 3/1892 | Loveland et al. | 29/1.2 |
| 2,019,795 | 11/1935 | Peterson | 29/1.2 |
| 2,510,430 | 6/1950 | Stevens | 29/1.2 |
| 2,696,130 | 12/1954 | Peters | 29/1.2 |
| 3,186,058 | 6/1965 | Mittelsteadt | 29/1.2 |
| 3,249,980 | 5/1966 | Eisenman | 29/1.22 |

*Primary Examiner*—Howard N. Goldberg
*Assistant Examiner*—Steven E. Nichols
*Attorney, Agent, or Firm*—St. Onge Steward Johnston & Reens

[57] ABSTRACT

A device is described with which a gas check can be squarely placed onto the shank of a cast bullet in a bullet sizing apparatus. The device is a gas check seating body with a laterally located slot so as to fit into the apparatus while partially enclosing a push rod below its head while resting on a shelf. The head of the push rod rests on the gas check seating body and supports an ejector rod located in the bore of the swaging die with an upper end so located that a gas check can be conveniently placed thereon. A bullet shank can then be forced into the gas check so it will squarely fit onto the bullet.

9 Claims, 5 Drawing Figures

20
10
22
30
18
40
24
46
16
32
34
36
50
14
56
54
S
48
52
60
28
64
63
44
30
55
L
54
48
64
55
54
48
60
64
62
64
12
30'
18
40
22
24'
34'
16
32'
14'
36'
50'
3
3
60
48
58
52'
64
28'
63
30'
30
48
60
62
18
42
40

GAS CHECK SEATING BODY

FIELD OF THE INVENTION

This invention generally relates to gas checks for bullets and more particularly, to an apparatus with which a gas check can be properly attached to a bullet in a bullet sizing apparatus.

BACKGROUND OF THE INVENTION

The development of smokeless powder in the latter nineteenth century allowed cast lead bullets to be driven at much higher velocities than was possible using black powder. New, high intensity cartridges were developed to make the most of this new propellant and chamber pressure in the barrel of the rifle doubled in some cases.

Up to, and during, this period, cast lead bullets had been made using pure or nearly pure lead. The base of the bullet rested right on the powder on very close to it. The higher pressures of the new smokeless propellants made two changes necessary. A harder bullet metal to withstand the increased velocity and something to protect the base of the lead alloy bullet from the cutting and erosive effects of the smokeless propellant.

As a result, a small cup of copper, or gilding metal, called the "gas check" was developed for use with high intensity cartridges. When a gas check is applied to the base of lead bullets designed to accept it, the gas check provides a substantial degree of protection to the bullet base and allows greater accuracy at the highest velocities generated by the smokeless propellants. Gas checks are currently widely used for this purpose and the use of cast lead alloy bullets has greatly increased in sophistication.

One of the major problems facing the shooter who employs cast bullets is the inability to apply the gas check squarely onto each bullet. A square fit of the gas check onto the bullet base has been found essential for accuracy.

Currently there are two types of gas checks. One type may be of a slip-on type and the other the crimp-on type. There are also a growing number of large and small bullet mold makers with their individual versions of gas check bullet designs.

The shooter who wishes to cast his own bullets and use a gas check design must find some way to squarely apply a gas check of one type or another onto the gas check shank of a bullet cast from a mold. Many gas checks are applied in conjunction with the sizing and lubricating of the cast bullet in devices made for that purpose. Such apparatus is called a lubricator-sizer of which there are a number of different versions available. Generally, the differences in the design specifications for bullets and molds and the normally large manufacturing tolerances that are encountered, make it very difficult to obtain a perfect square fit of a gas check onto a bullet using techniques involving such lubricator sizers. It is, therefore, desirable to provide a technique whereby a gas check can be fit squarely onto a cast bullet in a convenient manner.

SUMMARY OF THE INVENTION

With a device in accordance with the invention, a gas check can be accurately and squarely seated onto a bullet in a bullet sizing apparatus. This is accomplished with a replaceable gas check seating body which is adapted to fit between a shelf of the bullet sizing apparatus and a swaging die placed therein. The gas check seating body when operatively positioned seats an ejector rod employed in the swaging die so that the upper end of the ejector rod can freely receive a gas check to enable its initial alignment with the shank of a cast bullet before this is pressed into the gas check.

A replaceable gas check seating body in accordance with the invention can be conveniently applied to work with different bullet sizing apparatuses. Typically such apparatus applies a push rod from below to seat an ejector rod within the bore of a swaging die into which a bullet to be sized is forced from above with a ram. One form of a gas check seating body of this invention has a side located slot along its length so that the body can be moved to seat on a frame shelf below the head of the push rod and thus enable the ram to force a gas check squarely onto a cast bullet.

A gas check seating body can be conveniently placed within a sizing apparatus from a side thereof and removed subsequent to the application of a gas check onto a bullet so that further bullet processing such as its sizing and lubrication can be completed.

A gas check seating body in accordance with the invention has a length so as to fit between a shelf of a frame used in a bullet sizing apparatus and a swaging die placed in a section of the frame. The body can be installed either simply from the side or when space is too small to do that by advancing the body with its upper end first into the space and then swung directly below the swaging die in a position to properly seat the ejector rod. The flexibility of use of the gas check seating body enables the application of the same body in different bullet sizing apparatuses.

It is, therefore, an object of the invention to provide a device whereby a square attachment of a gas check onto a cast bullet can be conveniently obtained with a bullet sizing apparatus.

These and other advantages and objects of the invention can be understood from the following description of a preferred embodiment described in conjunction with the drawings.

DETAILED DESCRIPTION OF DRAWINGS

Figures 1, 2, 3, 4, 5:
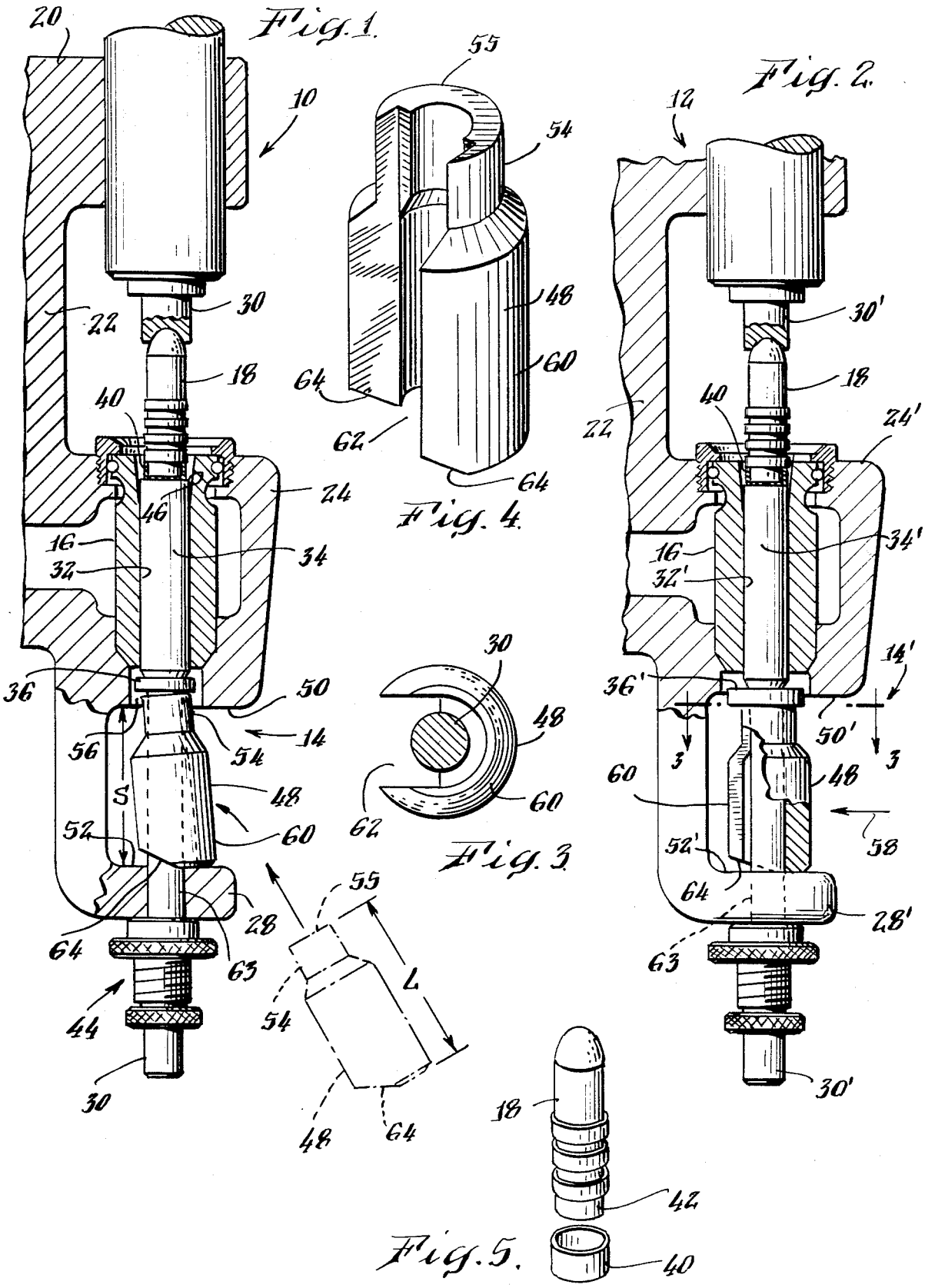
FIG. 1 is a section view of one type of bullet sizing apparatus with which a gas check seating body in accordance with the invention is to be used.
FIG. 2 is a section view of a different bullet sizing apparatus with a gas check seating body of this invention in place.
FIG. 3 is a top plan view of a gas check seating body in accordance with the invention.
FIG. 4 is a perspective view of a gas check seating body in accordance with the invention.
FIG. 5 is a perspective view of a cast bullet and a gas check for such bullet.

With reference to FIGS. 1 and 2, parts of different bullet sizing apparatuses 10, 12 are shown with the parts illustrated as generally similar except the segments 14, 14' where a gas check seating body of this invention is to be used. Each bullet sizing apparatus accommodates a plurality of different swaging dies such as 16 into which a cast bullet 18 is forced for appropriate sizing so that it will move properly through the barrel of a rifle. The apparatuses 10, 12 employ frames 20, 22 which have sections 24, 24' sized and shaped to receive swaging dies of various types. Lower shelves 28, 28' are used to support adjustable push rods 30, 30'. The frames 20, 22 each include a ram 30 with which a cast bullet 18 is forced in a swaging direction into a bore 32 of swaging die 16 for sizing. Ejector rod 34, 34' which are sized to slidingly fit within bores 32, 32' of the swaging die 16 are supported by heads 36, 36' of push rods 30, 30' affixed to shelves 28, 28' of frames 10, 12.

Attachments of a gas check 40 to the shank 42 of a bullet 18 (see FIG. 5) is obtained by first moving push rod up, after loosening the push rod adjusting mechanism 44. This brings the upper end 46 of ejector rod 34 as shown in FIG. 1 to a position in bore 32 where the gas check 40 can be freely introduced as well as provide sufficient space below push rod head 36 to fit a gas check seating body 48. This has a length L that exceeds the spacing S between the bottom surface 50 of frame section 24 and surface 52 of shelf 28 so as to require introduction, top end 54 first, into the recess 56 below die 16.

In the case of the bullet sizing apparatus 12 of FIG. 2 there is enough space to move gas check seating body 48 laterally from the side, as shown by the direction of arrow 58, below head 36' of push rod 30'.

Once gas check seating body 48 is in place, the ram 30, or 30' as the case may be, can be actuated to drive the bullet shank 42 into the gas check 40. Since the latter is seated on a flat, aligned top surface of ejector rod 32 or 32', the gas check 40 can be squarely placed onto the bullet shank 42, thus assuring a proper operation of the high velocity bullet.

The gas check seating body 48 as shown in FIGS. 3 and 4 has a generally cylindrical shape both at its lower end 60 and upper end 54. The upper portion 54 has a reduced cylindrical crossection that fits into a recess 56 below swaging die 16 in apparatus 10. Body 48 has a slot 62 along the length of the body. Slot 62 is sized to receive and partially enclose the shank 63 of push rod 30 or 30' while the upper portion 54 has a top surface 55 that fits below and abuts the push rod head 36. The overall length L of body 48 is selected to effectively seat gas check 40 at a location where the gas check 40 can be conveniently placed on the ejector rod 34. The reduced diameter of the upper portion 54 of the body also conveniently permits body 48 to be inserted upper end in first into the recess 56 below swaging die 16. The lower end of body 48 adjacent slot 62 is chamfered at 64 to permit body 48 to be swung into position to fit below push rod head 36 in the embodiment as shown in FIG. 1.

Having thus described a gas check seating body in accordance with the invention, its advantages can be appreciated. With a gas check seating body 48 in accordance with the invention a gas check can be squarely seated onto the shank 42 of bullet 18. The gas check seating body can be used in several bullet sizing devices. Variations from the described embodiment can be made without departing from the scope of the invention.

What is claimed is:

1. A device for squarely attaching a gas check onto a bullet in a bullet sizing apparatus having a frame which has one section shaped to receive a bullet swaging die through which a bullet is moved in a swaging direction while seated against an ejector rod located to snugly slide through the die, said frame further having a shelf spaced from the one section in the swaging direction, said shelf adjustably supporting a push rod one end of which may be adjustably spaced from the frame section so as to seat and move with the ejector rod when a bullet is pushed through the swaging die, comprising:

a replaceable gas check seating body having a length so as to fit between the frame shelf and the swaging die placed in said frame section while being of sufficient length so as to seat an ejector rod at a location where one end of the ejector rod can support a gas check and enables a shank of a cast bullet to be pressed into the gas check when so seated on the ejector rod.

2. The device as claimed in claim 1 wherein the gas check seating body has a side located slot which longitudinally extends along the swaging direction of the body and which slot is sized to receive the push rod from a side of the body to enable the gas check seating body to be operatively placed in said apparatus when one end of the push rod is near said swaging die.

3. The device as claimed in claim 2 wherein said one frame section has an opening extending therethrough and is sized to receive a swaging die, said frame section further extending towards the shelf of the frame so as to form below the swaging die a recess into which a head of the push rod extends;

said gas check seating body having an upper portion of reduced crossectional area so as to extend, when so operatively placed, into the recess.

4. The device as claimed in claim 3 wherein the gas check seating body has a lower end thereof chamfered adjacent said slot so as to enable the operative insertion of the body over the shelf when the spacing of the shelf from said one frame section is of shorter length than said body.

5. The device as claimed in claim 4 wherein said gas check seating body has a cylindrical shape.

6. For use in a bullet sizing operation having a frame for holding a bullet swaging die and a shelf spaced from the die in the direction of bullet movement through the swaging die, an ejector rod slidably positioned in said die and a push rod slidably positioned in said frame, a device comprising a removable body having a longitudinal slot for placement around said push rod between the shelf and the die, said device having an upper surface for effectively supporting one end of the ejector rod to maintain the ejector rod in the die and preventing downward movement thereof and to permit square seating of a gas check on a bullet when said device is inserted into the bullet sizing apparatus.

7. The device defined in claim 6 wherein said body is cylindrical and has a reduced diameter at its upper end.

8. The device defined in claim 7 wherein there is a chamfered portion adjacent said longitudinal slot to facilitate insertion and removal of the device to and from the space between said frame and said shelf.

9. A device for squarely attaching a gas check onto a bullet in a bullet sizing apparatus having a frame which has one section shaped to receive a bullet swaging die through which a bullet is moved in a swaging direction while seated against an ejector rod located to snugly slide through the die, said frame further having a shelf spaced from the one section in the swaging direction, said shelf adjustably supporting a push rod having a shank and an enlarged head at an upper end, said push rod being mounted to be adjustably spaced from the frame section so as to seat and move with the ejector rod when a bullet is pushed through the swaging die, comprising:

a replaceable generally cylindrically shaped, gas check seating body having a length so as to fit between the frame shelf and the head of the push rod when this is adjusted to be placed adjacent the swaging die so as to seat an ejector rod at a location where downward movement of the ejector rod is prevented and a gas check can be placed on a top surface of the ejector rod so as to enable a shank of a cast bullet to be pressed into the gas check, said body having a side located slot which longitudinally extends along the swaging direction of a shank of the body and which slot is sized to receive and partially enclose the push rod below its head, said gas check seating body further having an upper portion of reduced crossectional area so as to fit into a recess located below the swaging die while maintaining the head of the push rod in said recess with an upper surface of said body, said body further having a chamfered section at its lower end adjacent the slot so as to enable said body to be inserted and removed from the space between the swaging die and the frame shelf.

* * * * *